US006173944B1

(12) United States Patent
McCarthy

(10) Patent No.: US 6,173,944 B1
(45) Date of Patent: Jan. 16, 2001

(54) PLASTIC IN-LINE FENCING

(75) Inventor: Peter McCarthy, Woodbridge (CA)

(73) Assignee: Royal Group Technologies Limited, Woodbridge ( * ) Notice: Under 35 U.S.C. 154(b), the term of this patent shall be extended for 0 days.

(21) Appl. No.: 09/165,104

(22) Filed: Oct. 2, 1998

(30) Foreign Application Priority Data

Oct. 3, 1997 (CA) ..... 2217273

(51) Int. Cl.[7] ..... E04H 17/14
(52) U.S. Cl. ..... 256/19; 256/66
(58) Field of Search ..... 256/22, 19, 59, 256/65, 66, 21, 24

(56) References Cited

U.S. PATENT DOCUMENTS

| | | | | |
|---|---|---|---|---|
| 3,554,494 | | 1/1971 | Bee . | |
| 3,801,072 | * | 4/1974 | Newberry, Jr. | 256/24 X |
| 3,892,056 | * | 7/1975 | Mann | 256/21 X |
| 3,892,387 | * | 7/1975 | Mann | 256/24 |
| 4,114,597 | * | 9/1978 | Erb | 126/271 |
| 4,477,058 | | 10/1984 | Lowery . | |
| 4,722,514 | | 2/1988 | Pettit . | |
| 4,883,256 | * | 11/1989 | Hebda | 256/22 |
| 4,962,914 | * | 10/1990 | Taylor | 256/65 X |
| 5,372,354 | * | 12/1994 | Cacicedo | 256/22 |
| 5,454,548 | * | 10/1995 | Moore | 256/22 |
| 5,556,079 | * | 9/1996 | West | 256/22 |
| 5,601,279 | * | 2/1997 | Schwartz et al. | 256/66 |
| 5,613,664 | * | 3/1997 | Svalbe | 256/66 X |
| 5,660,378 | * | 8/1997 | Schall | 256/65 |
| 5,846,620 | * | 12/1998 | Compton | 428/35.7 |
| 5,938,184 | * | 8/1999 | DeSouza | 256/19 |
| 5,988,599 | * | 11/1999 | Forbis | 256/24 |
| 6,039,307 | * | 3/2000 | De Zen | 256/19 |

* cited by examiner

*Primary Examiner*—Lynne H. Browne
*Assistant Examiner*—John R. Cottingham

(57) ABSTRACT

A fence section comprising at least two elongated parallel hollow plastic fence rails having a series of registering apertures in opposing walls thereof to provide a series of picket receiving, passages therethrough spaced along and perpendicular to their length. A plurality of plastic pickets are inserted through the rail passages with the pickets in line along the length of the rails. Each picket has a passageway therethrough located within the rails. An elongated metal reinforcing and locking member is located within and slidable longitudinally of the rails to project through the aligned picket passageways to lock the pickets from removal from the rails while reinforcing the rails.

5 Claims, 3 Drawing Sheets

PLASTIC IN-LINE FENCING

FIELD OF THE INVENTION

This invention relates to plastic fencing and, more particularly, to in-line plastic fencing.

BACKGROUND OF THE INVENTION

Plastic fencing is now becoming much more widespread because of the many advantageous properties available with plastic. As a result, fences can be produced which do not rot, corrode, warp or splinter and which are impervious to insects and weathering rendering them highly durable and maintenance free. By making the fence components as hollow extrusions, they are cost effective, light in weight, and easy to handle and may, where desired, be strengthened by reinforcing inserts.

In typical plastic fencing, such as illustrated in U.S. Pat. No. 3,554,494, granted Jan. 12th, 1971, the rails are simply screwed to the faces of the posts with these screws being readily accessible by popping off the plastic domes for unauthorized removal of the rails.

U.S. Pat. No. 4,722,514, issued Feb. 2nd, 1988, discloses an inline plastic fence in which the slats merely span between the rails with the ends projecting into the rails their assembly relying solely on friction until the rails are assembled with the posts to prevent their separation.

U.S. Pat. No. 4,477,058, issued Oct. 16th, 1984, discloses a plastic picket fence in which they fence boards or pickets while extending above and below the rails are secured merely by a plastic snap fitting. Moreover, many of the pickets or slats display unsightly grooves.

It is the object of the present invention to provide a plastic fence structure in which the pickets are secured in position projecting through and in line with the hollow plastic fence rails by a locking means located interiorly of at least one of the rails to provide a highly aesthetic fence section having a completely hidden tamper proof locking arrangement.

It is a further object of the invention to utilize the locking means for the pickets as a reinforcement for the rail or rails in which it is employed.

SUMMARY OF THE INVENTION

The invention resides in providing a novel means of securing slats or pickets to the hollow rails of a plastic fence whereby the pickets can be inserted through the rails to be in line therewith and then locked in position by a simple totally concealed slidable locking means operated within at least one of said hollow rails whereby the pickets are locked in position without the use of screws, nails or the like and without any external evidence of the securement which would detract from the aesthetics of the fencing.

Further, according to another aspect of the invention, the locking means is utilized to form a reinforcement for the hollow plastic rail or rails in which it is employed.

These and other objects and features will become apparent from the following detailed description taken in conjunction with the accompanying drawings.

DETAILED DESCRIPTION ACCORDING TO THE PREFERRED EMBODIMENTS OF THE PRESENT INVENTION

Figure 1:
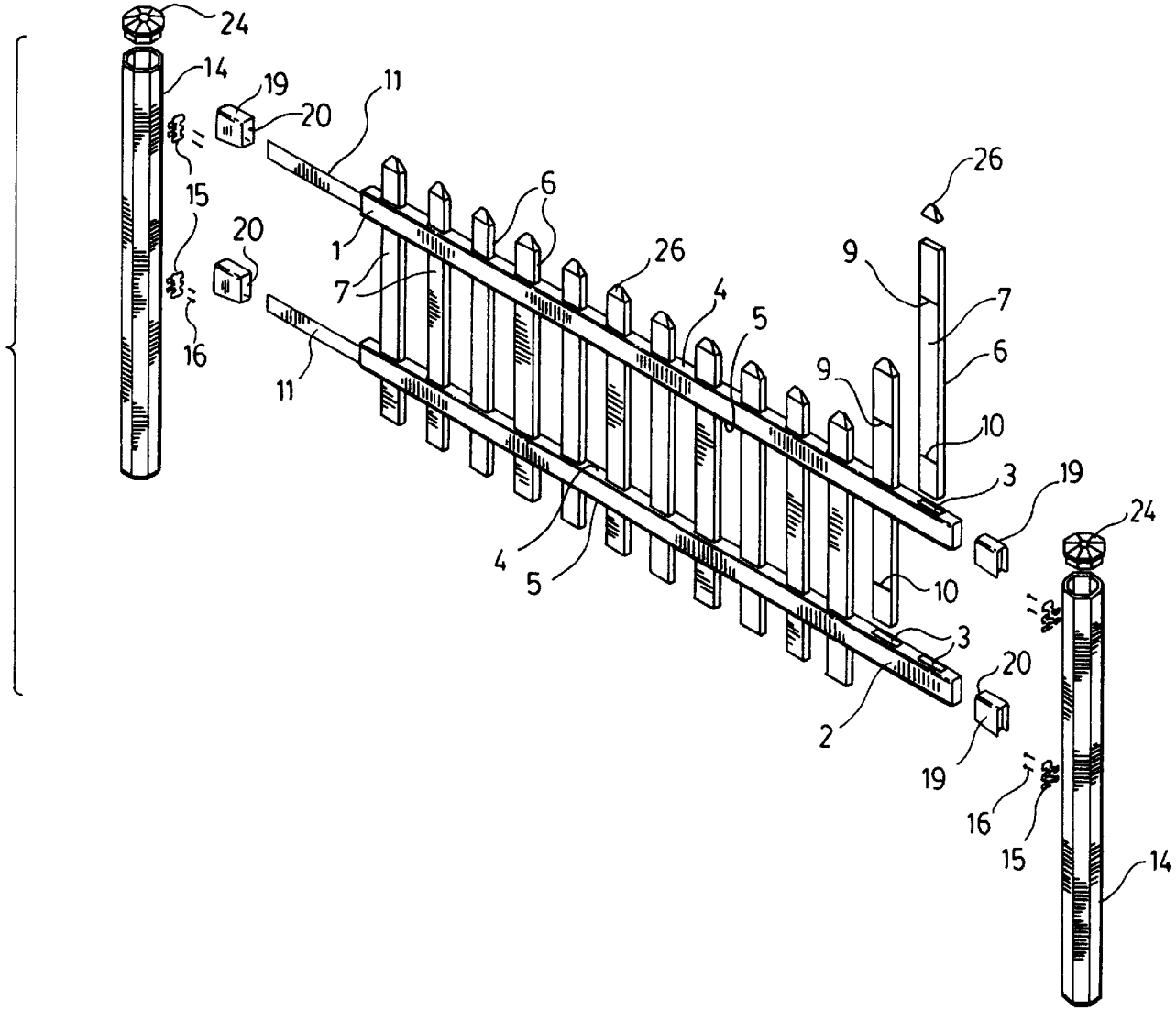
FIG. 1 is an exploded perspective view illustrating the assembly of the rails and in-line pickets with the last two pickets in different stages of assembly prior to being engaged by the sliding locking mechanism prior to mounting the fence section to the fence posts.

With reference to FIG. 1, there is illustrated a simple example of a fence section embodying the invention, the section comprising a pair of spaced parallel hollow plastic rails having a plurality of pickets also formed of plastic inserted therethrough. Each of the rails comprising the top rail 1 and the bottom rail 2 is provided with a series of apertures 3 spaced uniformly along the length thereof through both the top and bottom rail walls 4 and 5 to provide passages therethrough perpendicular to the axis of the rails, the apertures being of the size and shape to slidably receive pickets 6 which can be sleeved therethrough.

FIG. 1 shows all of the pickets with the exception of the last two sleeved through the rails 1 and 2 to their final desired position. The second to the last picket is shown having been passed through the upper rail 1 and about to be inserted through the lower rail 2. The last picket is shown ready to be inserted through the upper rail 1.

The rails 1 and 2 are shown as having oblong or rectangular cross-section presenting generally planar faces 8 and planar top and bottom walls 4 and 5 with the depth of the rails, that is the width of the planar faces 8 being somewhat greater than the width of the rails.

Each of the pickets 6 also preferably comprises a rectilinear hollow plastic member presenting faces 7 which are wider than the thickness of the pickets.

As illustrated in FIG. 1, the last two pickets 6 are provided with upper and lower saw cuts 9 and 10 respectively in one of their faces 8. It will be understood that all of the pickets 6 will have the same saw cuts.

These saw cuts 9 and 10 are spaced corresponding to the spacing of the rails 1 and 2 so that, when the pickets are inserted through the rails to the desired position illustrated in FIG. 1 for all of the pickets except the last two, the upper saw cut 9 will be contained within the upper rail 1 and the lower saw cut 10 will be contained in the lower rail 2.

It will be understood that with all the pickets in place the saw cuts 9 in the upper rail 1 will be in longitudinal alignment within the rail 1 while the saw cuts 10 will be in longitudinal alignment within the lower rail 2.

As illustrated in FIG. 1, to secure the pickets in position a longitudinal locking member 11 is slidably mounted in each of the rails 1 and 2.

Figure 2:
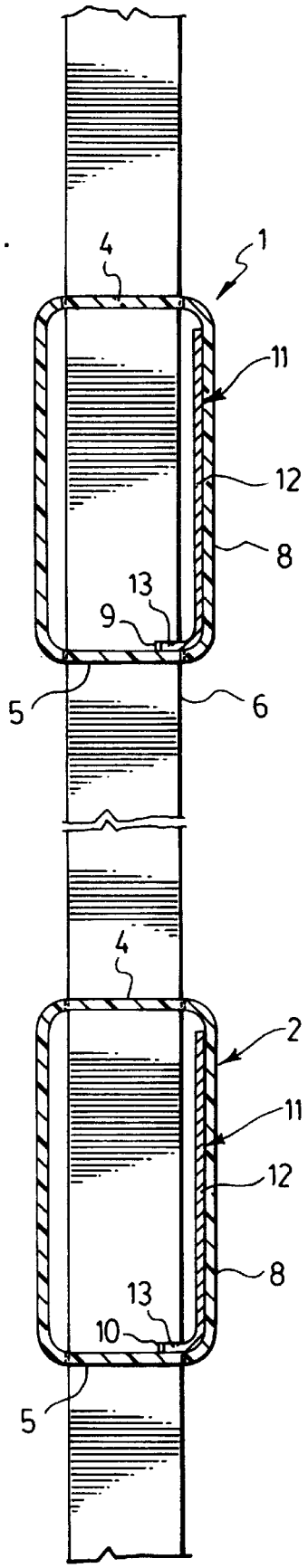
FIG. 2 is an enlarged broken away vertical section through the fence rails and showing one of the pickets locked in position in both the upper and lower rails.
Figure 3:
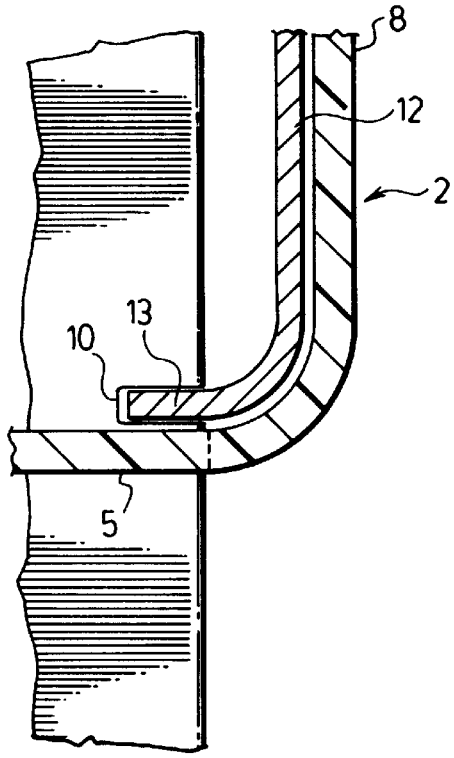
FIG. 3 is an enlarged sectional view illustrating the interlock between one of the pickets and the locking mechanism in the lower rail.

As shown in FIGS. 2 and 3, the slidable locking member 11 comprises an elongated J-bar preferably of metal having an elongated web 12 extending substantially the full height of the interior of the rail in which it is mounted and located between the picket 6 and the adjacent side wall of the rail.

At the lower end, the web 12 is turned inwardly to provide a short laterally projecting edge or ledge 13 disposed substantially at right angles to the web 12 with the ledge 13 projecting into the saw cut or slot in the face 8 of the picket.

It will be understood that, for example, with respect to the locking member or J-bar 11 in the upper rail 1 the laterally projecting ledge 13 as it is pushed through the hollow rails will successively pass through the aligned upper saw cuts or slots 9 until the J-bar is fully home with its longitudinal ledge 13 engaged in the slot 9 of each of the pickets.

Similarly, when the locking member or J-bar 11 is slid home in the lower rail 2, its locking ledge 13 will be engaged in each of the aligned lower saw cuts or slots 10 of the pickets.

It will be understood that the engagement of the locking ledge 13 of the locking members 11 in the slots or saw cuts 9 and 10 will prevent downward movement of the pickets while the elongated web 12 of the locking member extending substantially the full height of the rails will prevent upward movement of the pickets.

While the locking members 11 have been shown as J-bars, it will be understood that the web 12 could be formed, for example, to have an inwardly projecting ledge at points intermediate its height. The saw cuts 9 and 10 in the faces 7 of the pickets would of course be correspondingly adjusted in their location.

It will be appreciated that various other locking members utilizing the principle of the sliding locking action engaging through passageways through the pickets may be employed.

It will also be understood that the use of a locking member 11 in only one of the rails 1 or 2 will still provide a positive lock against unauthorized removal of the pickets while securing the pickets in their proper position.

It will also be understood that, while the invention is illustrated with respect to a fence section having two rails, for longer pickets three or more rails may be employed with locking effected in some or all of the rails as described above.

In addition to forming a locking mechanism, the longitudinal J-bars 10 or other corresponding locking members which may be employed also serve the second function of reinforcing the hollow rails.

Figure 4:
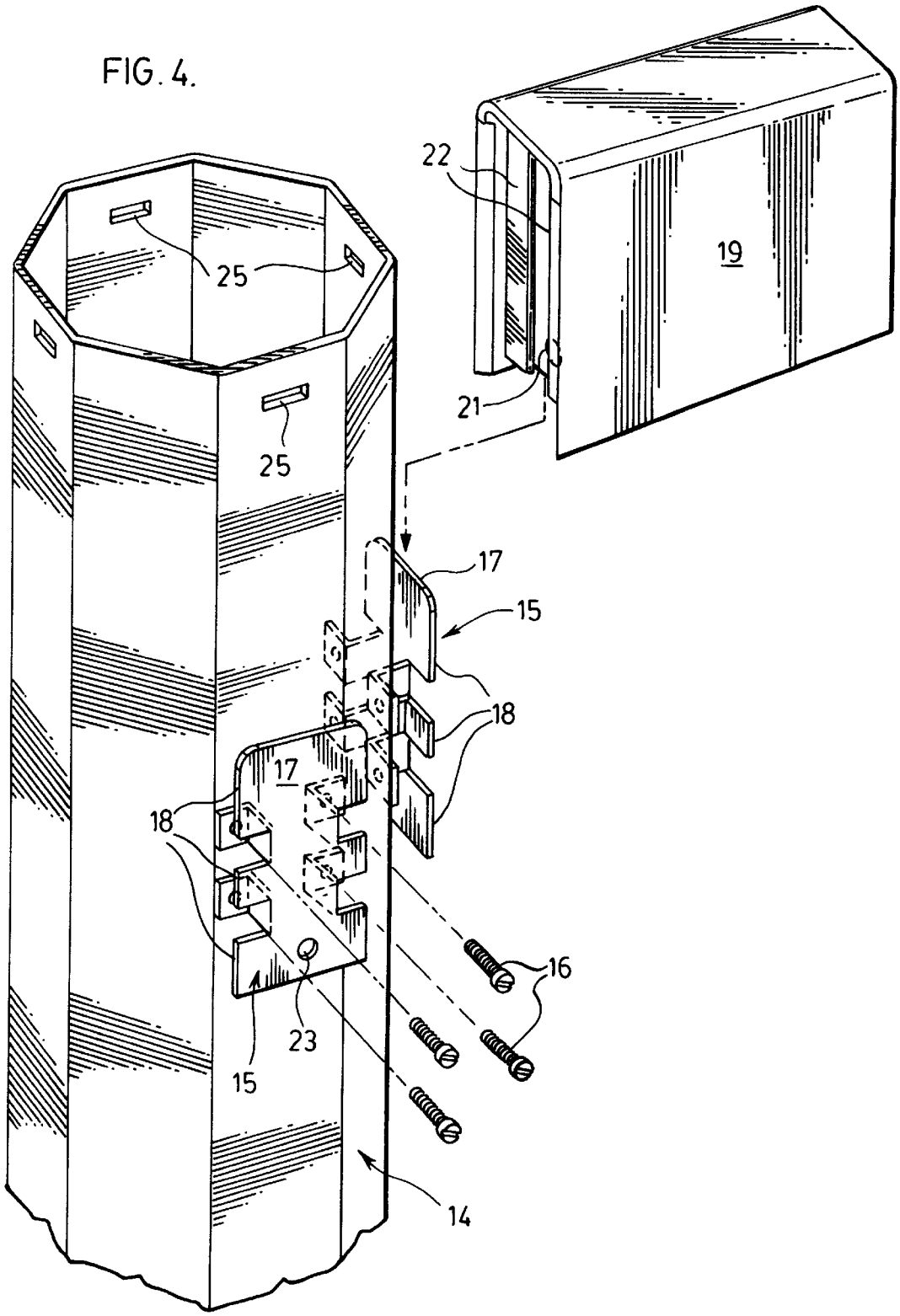
FIG. 4 is a perspective view illustrating one particular advantageous means for attaching the in-line picket fence section of the invention to a fence post.

It will be understood that the fence section comprised by the rails 1 and 2 and pickets 6 locked in position by the locking members 11 is to be supported between fence posts and, while of course this could be done in a number of different ways, a particularly advantageous mounting arrangement is illustrated in FIG. 4 which forms the subject matter of applicant's copending Canadian Application S.N. 2,192,504.

As illustrated, the post 14 also formed of plastic is shown as having an octagonal cross-section so that the fence sections can be run off in various different directions as desired. FIG. 4 shows two hanger members 15 secured to adjacent faces of the post 14 by screws 16.

Very briefly, each of hanger members 15 is formed with a plate portion 17 standing proud of the post 14 and parallel thereto presenting lateral extensions 18 for securing a mounting bracket 19 securely against the face of the post. The bracket 19 is in the form of a short sleeved portion 20 of a size and shape to receive the end of one of the rails 1 or 2 while at the opposite end the bracket 19 is formed with a wall 21 to contact the outside of the plate portion 17 and with a pair of inwardly projecting flanges 22 to engage behind the plate portion 17 of the hanger member.

Thus, as illustrated in FIG. 4, the bracket 19 can be secured to the post 14 by simply pressing the one end against the face of the post to which the hanger member 15 is secured. Then, by sliding the bracket downwardly, the flanges will be lodged behind the plate portion 17 with the outer face of the plate abutting the bracket wall 21. To ensure a very tight fit, the hanger 15 is provided with suitable arrangement of protubrances such as the protubrance 23 which will seat home in a suitable socket or opening (not shown).

It will understood that in erecting the fence section the posts 14 can be first installed at essentially the correct spacing then, after the locking members 11 have been slid fully home to lock in all of the pickets 6, the brackets 19 are slid on the ends of the rails 1 and 2 and with the hanger members 15 in place the section can be mounted by sliding it vertically downward against the respective post faces.

It will be understood that the sleeved portions 20 of the mounting brackets will have a sufficient length that a minor amount of play in the telescopic relation between the brackets and the rails is provided to make adjustment for minor variations in the spacing of the posts.

For aesthetic purposes, the posts 14 are provided with decorative caps 24 provided with tabs (not shown) for interlocking in the post slot 25. Also, the pickets are provided with end caps 26 adapted to be friction fitted to the ends of the pickets.

The rails 1 and 2, pickets 6, and posts 14 are all preferably coextrusions to provide a polyvinyl core coated with an exterior protective cap stock containing suitable agents to protect against ultraviolet radiation, provide impact resistance, coloring agents and the like as desired. The cap stock provides a smooth, clean exterior surface while the underlying core or substrate can employ reprocessed thermoplastics.

The hanger members 15 and the locking members 11 are preferably formed of metal such as sheet steel while the brackets 19 may be formed by an injection molding.

With the fence section comprised by the rails 1 and 2 and pickets 6 with their caps 26 locked in position by the locking members 11 and the fence section connected to span between its supporting posts, the fence section presents a very aesthetic appearance in which the pickets are perfectly in line with their longitudinal axis intersection the longitudinal axis of the rails at rights angles thereto and the pickets are securely locked in position without the use of any screws, nails or like fasteners and without requiring any use of tools. Moreover, not only are the pickets securely and accurately held in place but the securement is tamper proof.

It will be understood that variations in the detail may be made without departing from the scope of the appended claims.

The embodiments of the invention in which an exclusive property or privilege is claimed are defined as follows:

1. A fence section comprising at least two elongated parallel hollow plastic fence rails having a series of registering apertures in opposing walls thereof to provide a series of picket receiving passages therethrough spaced along, and perpendicular to their length, a plurality of hollow plastic pickets inserted through said rail passages, said pickets being in line along the length of said rails, each picket having at least one passageway therethrough located within at least one of said rails with said picket passageways being in alignment along the length of at least said one rail, and an elongated metal rail reinforcing and picket locking member located within and slidable longitudinally of at least said one rail to be projected through said aligned picket passageways to lock said pickets from removal from said rails, said metal rail reinforcing and locking member being located entirely within and protected by at least said one rail when in picket locking position.

2. A fence section as claimed in claim 1 in which said hollow plastic rails and pickets have a generally rectilinear cross-section, said rails having a top wall and a bottom wall and side walls having a height greater than the width of said top and bottom walls and said apertures in said rails are formed in said top and bottom walls and said picket receiving passages have their axes intersecting the longitudinal axes of said rails.

3. A fence section as claimed in claims 1 or 2 in which said rails and pickets are coextrusions of a thermoplastic substrate coated with a protective cap stock.

4. A fence section as claimed in claim 2 in which said pickets present planar faces at each side of said rails and said passageways through said pickets comprise saw cuts in one of said planar faces and said elongated reinforcing and locking member is formed to slide between the planar faces of said pickets having said saw cuts and the adjacent rail side wall, said reinforcing and locking member extending substantially the full height of said rail side wall and having an inturned ledge engaging in said picket saw cuts.

5. A fence section as claimed in claim 3 in which said thermoplastic substrate is reprocessed thermoplastic.

* * * * *